United States Patent [19]

DeBin

[11] Patent Number: 4,735,602

[45] Date of Patent: Apr. 5, 1988

[54] BAG STACKING METHOD AND APPARATUS

[75] Inventor: Rene' F. DeBin, Aalst, Belgium

[73] Assignee: FMC Corporation, Chicago, Ill.

[21] Appl. No.: 56,297

[22] Filed: May 29, 1987

Related U.S. Application Data

[63] Continuation of Ser. No. 912,204, Sep. 25, 1986, abandoned, which is a continuation of Ser. No. 654,586, Sep. 26, 1984, abandoned.

[51] Int. Cl.[4] ..... B31B 1/64

[52] U.S. Cl. ..... 493/204; 493/196

[58] Field of Search ..... 83/278; 493/196, 204, 493/227, 239; 269/289 R; 17/1 S; 411/489, 498, 450, 456; 211/57.1, 59.1

[56] References Cited

U.S. PATENT DOCUMENTS

| | | | |
|---|---|---|---|
| 688,769 | 12/1901 | Young | 211/57.1 |
| 3,533,511 | 10/1970 | Giampa | 211/57.1 |
| 3,555,977 | 1/1971 | Saumsiegle | 83/30 |
| 4,198,260 | 4/1980 | Mundus et al. | 493/204 |
| 4,218,276 | 8/1980 | Kim | 156/253 |
| 4,451,249 | 5/1984 | deBin | 493/196 |
| 4,459,172 | 7/1984 | Achelpohl et al. | 493/204 |

FOREIGN PATENT DOCUMENTS

| | | |
|---|---|---|
| 1561974 | 5/1970 | Fed. Rep. of Germany . |
| 2928729 | 1/1981 | Fed. Rep. of Germany . |
| 2490997 | 2/1982 | France . |

*Primary Examiner*—Frederick R. Schmidt
*Assistant Examiner*—Robert Showalter
*Attorney, Agent, or Firm*—Raymond E. Parks; Douglas W. Rudy; Richard B. Megley

[57] ABSTRACT

Disclosed is stacking arrangement for accumulating a plurality web segments of substantially identical dimensions on sharpened pins projecting upwardly from a support plate located at a stacking station. As each web segment is produced, it is firmly held or grasped on opposite sides of its medial area and impalled on and penetrated in the medial area by the sharpened pins. Release of the segment from the grasping force occurs after the segment has been penetrated by the pins.

3 Claims, 4 Drawing Sheets

BAG STACKING METHOD AND APPARATUS

This application is a continuation of application Ser. No. 912,204, filed 9/25/86, now abandoned, which is a continuation of application Ser. No. 654,586, filed 9/26/84, now abandoned.

The present invention relates to a method and apparatus for stacking thermoplastic bags and more particularly to stacking bags on sharpened pins that penetrate the web material.

The subject matter of the present invention is related in substantial respect to the subject matter disclosed in U.S. Pat. No. 4,451,249 issued May 29, 1984 and in U.S. patent application Ser. No. 528,926 filed on Sept. 2, 1983 and owned by the assignee of the present invention.

The disclosure of the referenced patent describes a bag production technique whereby an elongate strip of tubular thermoplastic material is provided with two of more holes adjacent its longitudinal median. At regularly spaced intervals the web is severed and sealed to define a generally rectangular web portion which is referred to as a web segment. Each segment contains at least one hole on opposite sides of the longitudinal median serving to be received on pins carried by a stacking device which is part of a wicket conveyor. Each segment, as it is produced is transferred in an arcuate path to the stacking device.

The subject matter of the present invention has particular utility if it is desired to produce bags, while of the same type disclosed in a referenced patent, but without providing holes in each web segment. Stacking is achieved by substituting sharpened pins on each of the stacking plates carried by the wicket conveyor so that web segments transferred for stacking are pierced and collected on the stacking device. Thus the web segments need not be provided with holes and any resistance encountered in piercing the web segments is overcome by the manner in which a conventional vacuum arm transfer device is valved to retain a firm grip on each web segment until the segment has been pierced by the sharpened pin.

Thus, according to the present invention, web segments of equal dimensions are derived from an intermittently advanced elongate strip of thermoplastic material which is severed and sealed transversely to the direction in which it is advanced during periods of repose. As each segment is produced, it is firmly grasped on opposite sides of its medial zone by a conventional rotary vacuum arm assembly and transferred to a receiving or stacking device where a plurality of successive segments are accumulated on the stacking device and in the course thereof are pierced by upwardly extending sharpened ends that penetrate the medial zone of each segment and thus effect stacking of a plurality of segments.

DESCRIPTION OF THE PREFERRED EMBODIMENT

Figure 1:
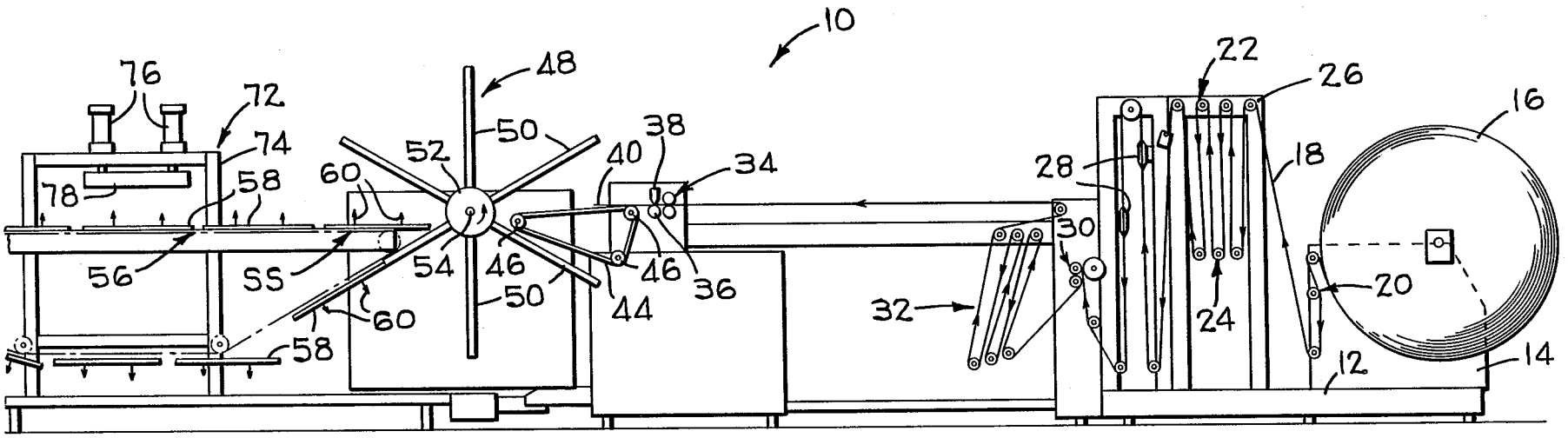
FIG. 1 is diagrammatic elevation of a major portion of a bag making and stacking machine incorporating the novel subject matter of the present invention.

FIG. 1, which is similar in substantial respects in construction and mode of operation to the subject matter disclosed in the U.S. Pat. No. 4,451,249 will be described to merely point out the major components and their organization so that the novel subject matter of the present invention may be described in context. The overall machine, generally indicated by the numeral 10, and its major components comprise a base plate 12 supporting a unwind stand 14 mounting for free or controlled rotation a roll of thermoplastic materials 16. The unwound strip 18 passes over a plurality of idle rolls, collectively identified as 20, and over upper and lower sets of idler rolls 22 and 24 carried by tower structure 26. While not shown, the idler rolls 24 are mounted for upward and downward vertical movement and serve to accumulate and provide a proper amount of tension to the web strip 18. The tower structure also is provided gusseting devices 28 to form inward folds to the web strip. After passing through web drive rolls 30 and another accumulating and tensioning device 32, the web strip 18 is intermittently advanced by draw rolls 34 serving to project a selective length of a web strip beyond a platen roll 36 and an oppositely disposed heated seal bar 38. As is conventional in the art, the time period for a draw roll rotation is determined by the length of the web strip 18 which is projected beyond (from right to left as used in FIG. 1) the seal bar. On arresting the draw roll rotation the seal bar 38, which is elevated during web advance, is lowered in pressure engagement with the seal roll and accordingly the leading portion of the web, indicated by the numeral 40, is severed and sealed thereby defining a web segment 42 shown in FIGS. 2 and 3.

The leading portion of the web 40 projected beyond the seal bar 38 is laterally supported by a series of belts 44 traveling in a generally triangular path defined by a plurality of rollers 46.

A rotary transfer mechanism 48 comprising a plurality of radially extending circumferentially spaced hollow bars or arms 50, having their inner ends rigidly connected a split hubs 52 and rotating about the axis of shaft 54, and transfer the leading portion of the severed web 40 in an arcuate path for collection on a conveyor 56 which comprises a plurality of stacking plates or devices 58 each of which mount upwardly extending sharpened pins 60.

Figure 3:
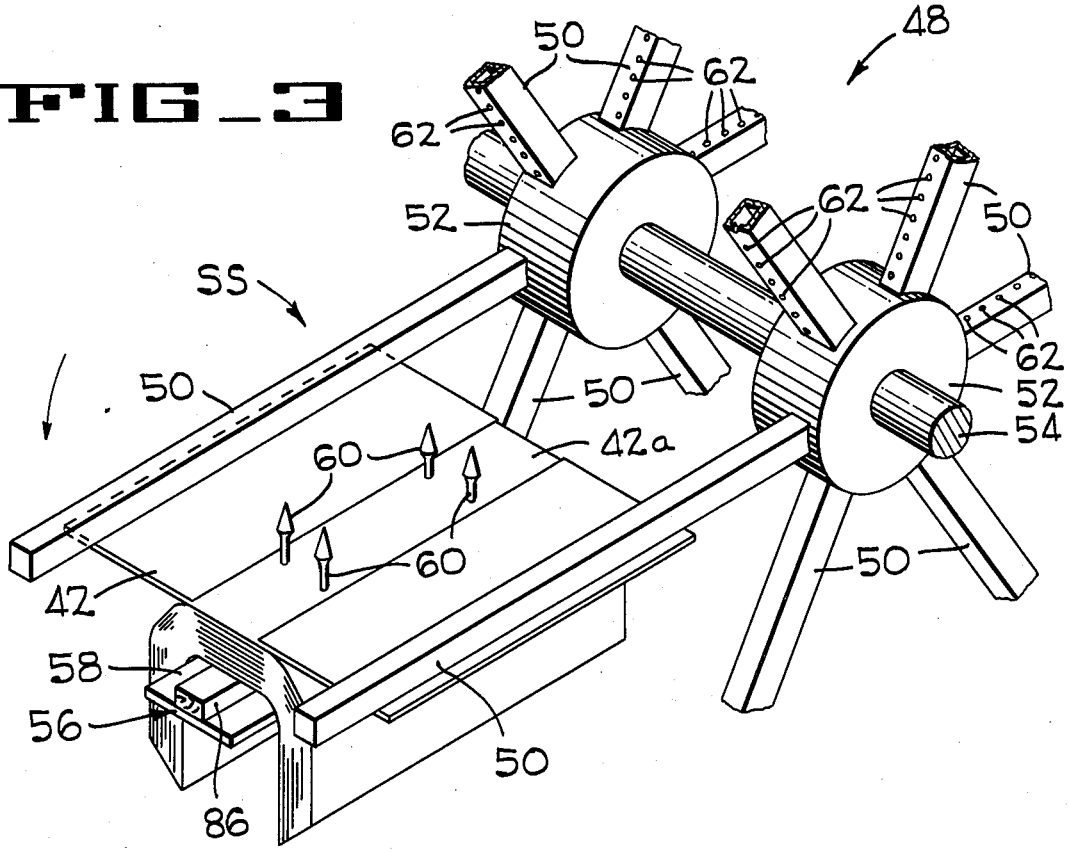
FIG. 3 is a diagrammatic prospective illustrating the accumulation of a plurality of web segments and a web segment which has been pierced by pins.

As shown in FIG. 3, the transfer mechanism 48 includes two hubs 52 axially spaced on the shaft 54 and each hub mounts a set of radially extending circumferentially spaced hollow arms or bars 50. As is conventional the stationary portion of the split hubs 52 is connected to a source of vacuum (not shown) communicating with each of the arms 50 which are secured to the rotating half of the split hubs. Each of the arms 50 is provided with a series of small diameter holes 62 on the face of the bars that come into to contact the leading portion of the web 40 and thereby the web portion is grasped due to blocking of the holes 62. The grasped web segment is transferred in an arcuate path to one of the stacking plates 58 located at a stacking station SS.

Figure 2:
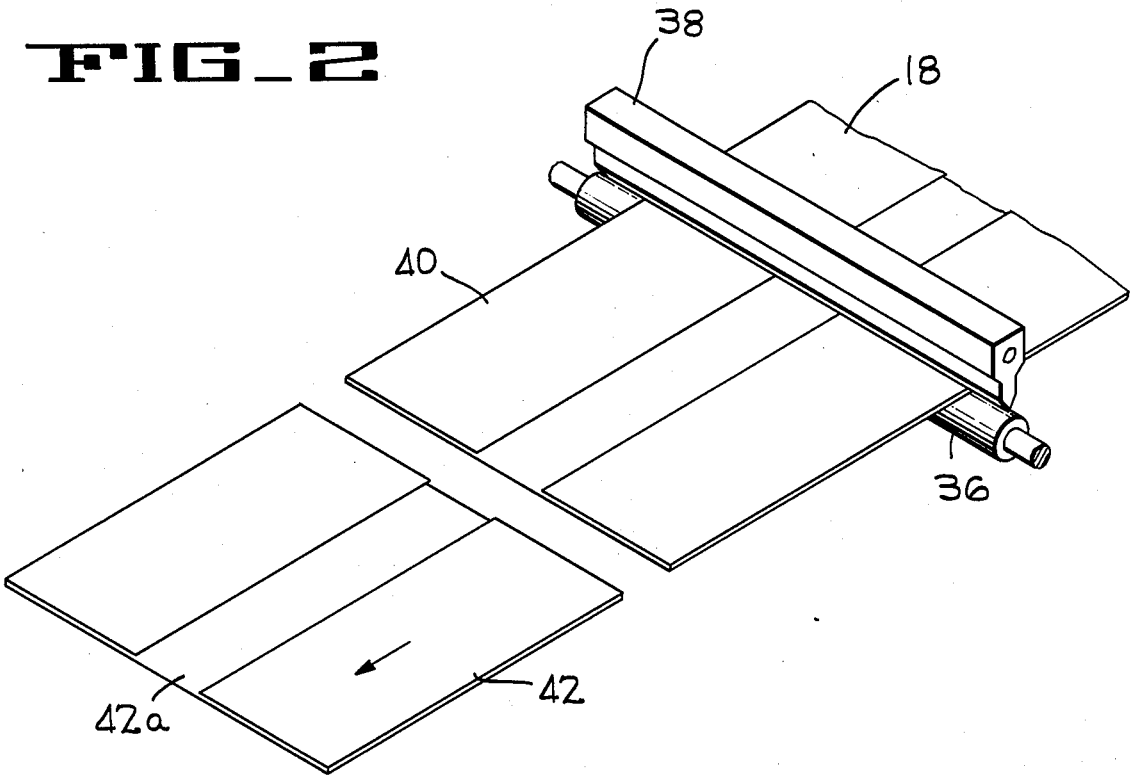
FIG. 2 is a diagrammatic perspective showing one form the web segment can take and the cooperation of a seal bar and platen roll to produce a web segment.

FIG. 2 shows, in greater detail, the relationship of the seal bar 38 and the platen roll 36. When the seal bar 38 comes into pressure engagement with the platen roll the leading portion 40 of the web 18 is severed and sealed to produce the web segment 42. It is to be understood however, that as soon as the leading portion of the web 40 is severed and sealed it is engaged by a pair of opposed bars 50 and transferred as mentioned above.

Reference to FIG. 3 will reveal accumulation of a plurality of web segments 42 on a stacking plate positioned at the stacking station SS. It also should be noted that the web segment 42, shown in FIG. 2, has its central zone **42*a* free of holes or perforations in contrast with preparation of the web segment as disclosed in the referenced U.S. Pat. No. 4,451,249. FIG. 3 shows the stacking plate 58 provided with four upwardly projecting pins 60 having their upper ends sharpened such as to take the form of a pencil point so that as the web segment 42 carried by the arms 50 approach the stacking plate 58 the pins 60 pierce the web and accordingly the stack of web segments assume a registered orientation; meaning that the stack of web segments overlie each other such that corresponding edges are even. It is to be recognized that vacuum to the arms 50 is maintained to a sufficient level to firmly hold the web segments 42 until the resistance of the film or web to puncturing by the pins 60** has been overcome.

Figure 4:
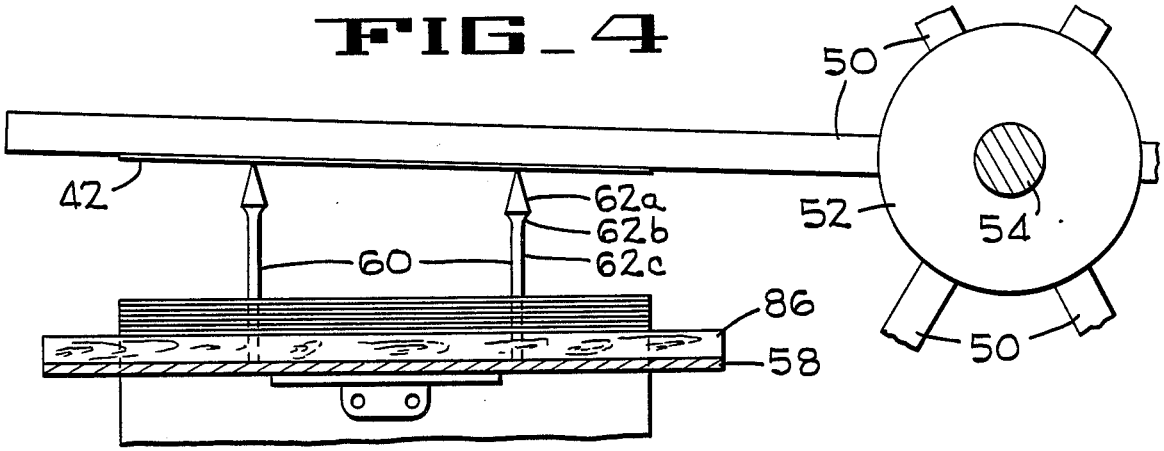
FIGS. 4, 5 and 6 illustrate the sequence of events occurring when a web segment is adjacent the upper end of the sharpened pins, the deformation of the web as the pins impart perforating stresses and piercing of a web segment.
Figure 5:
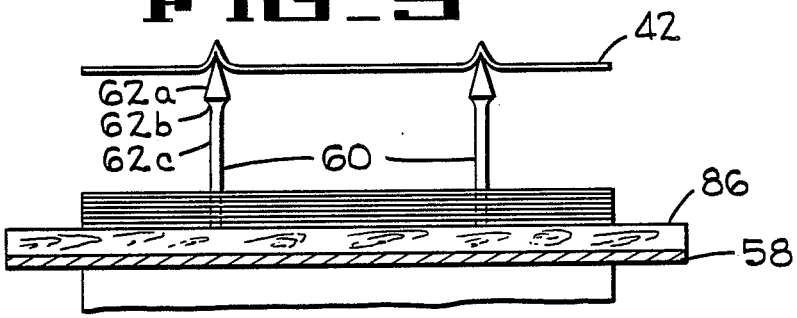
Figure 6:
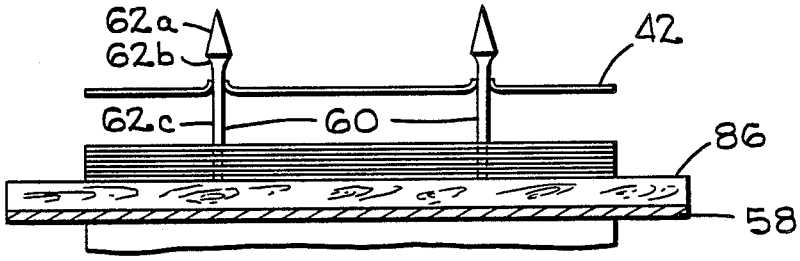

With reference now to FIGS. 4, 5 and 6 the progressive action involved in piercing and plunging a web segment 42 on the pins 60 is illustrated. If desired, the elevation of the pins 60 from the plate 58 can be made so that the upper tips of the pins 60 concurrently engage the web segment 42 and therefore all pins penetrate the webs at the same time. It should be recognized however that the pin can be made the same elevation such that penetration occurs sequentially rather than concurrently. FIG. 5 illustrates deformation of the web by the tips of the pins 60 while FIG. 6 shows the web penetrated by the pins. As indicated above the vacuum supplied to the bars 50 is maintained until the web segment 42 is pressed downwardly onto the surface of the plate 58 or the surface of previously stacked segments.

The piercing stacking pins 60 are formed with a conical point **62*a* and a transition radius 62*b* blending the base of the conical point 62*a* with a smaller diameter shank 62*c*. Providing a shank 62*c* of smaller diameter than the diameter of the base of the cone 62*a* facilitates producing a compact stack of web segments since the diameter of the hole produced by the pins 60 is substantially equal to the diameter of the base of the cone 62*a* which is somewhat greater than the diameter of the shank 62*c*. In this way after the web segment has progressed beyond the base of the cone 62*a* its resistance to being compactly stacked against the plate 58** or previously stacked segments is eliminated or substantially reduced.

Figure 7:
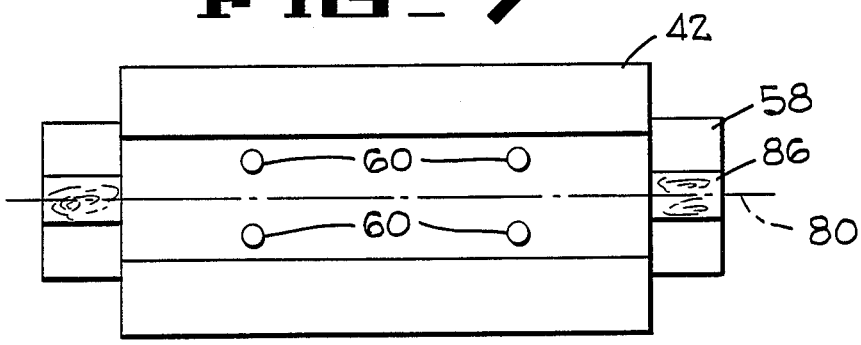
FIG. 7 is a plan of a stacking plate carrying a group of accumulated web segments.

After a selected number of web segments have been stacked on a particular stacking plate 58, the conveyor is indexed (from right to left as viewed in FIG. 1) toward a cutting or a cutting and sealing mechanism 72 which comprises a frame structure 74 supporting a pair of concurrently operable linear actuators 76 having their output rods **76*a* connected to a knife or other suitable cutting element 78 serving to cut or cut and combine a stack of web segments located thereunder along the imaginary line 80 shown in FIG. 7 and in applicant's aforementioned U.S. patent application Ser. No. 816,692, filed on Sept. 2, 1983. It will be noted that the knife is projected between the pins 60 whereby cutting along the line 80** produces two bag stacks which are retained on the conveyor until unloading or removal occurs.

Figure 8:
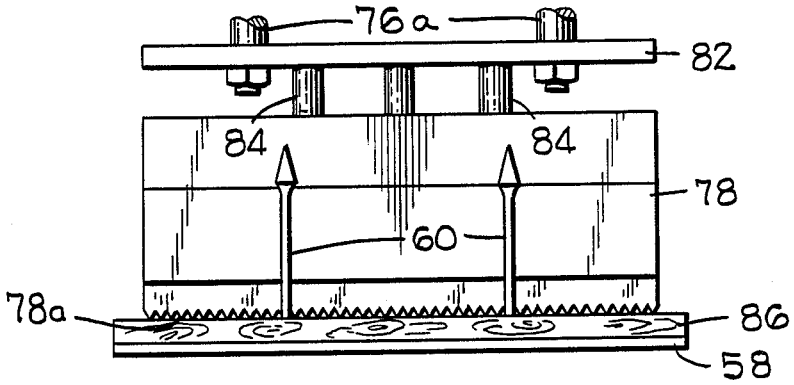
FIG. 8 is an elevation of a web segment cutting station.

As shown in FIG. 8 the rods **76*a* of the actuators 76 are connected to a cross head 82 which in turn has rigidly attached thereto by any suitable means such as fasteners 84 the knife 78. In order to maintain the integrity or life of the edge 78*a* of the knife 78 a deformable insert 86, which may be a strip of wood, is affixed to the plate 58 and forceably engaged by the knife edge 78*a*** in the course of dividing the stack of web segments into individual bag stacks.

Figure 9:
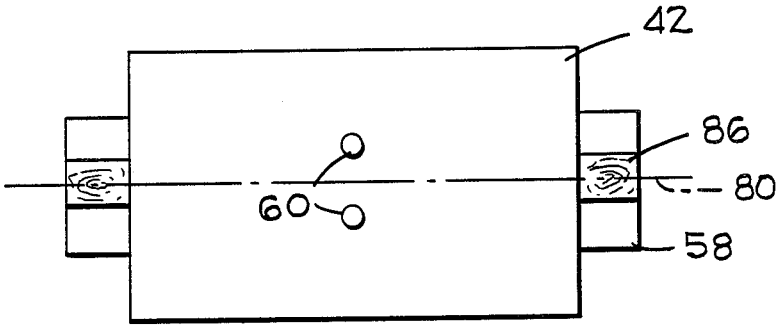
FIG. 9 is a plan of a modified stacking plate provided with two stacking pins.
Figure 10:
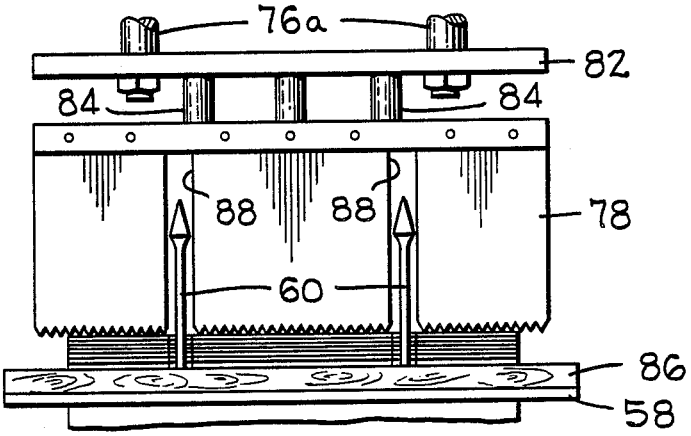
FIG. 10 and 11 are, respectively, an elevation and plan of a modified cutting device and a stacking plate wherein stacking pins are located on a medial line and the cutting knife is relieved or slotted.
Figure 11:
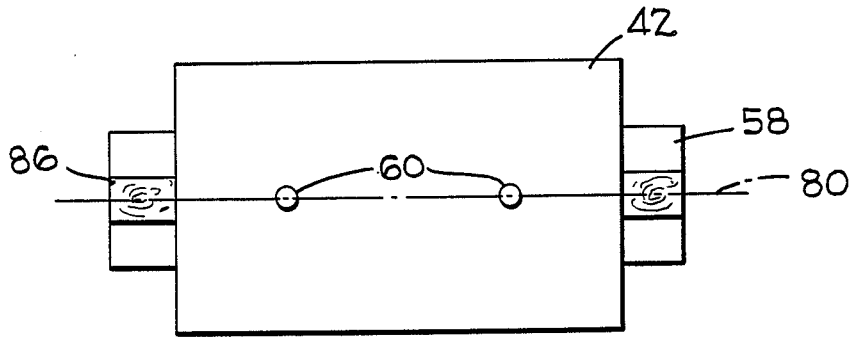

FIG. 9 shows a modification whereby each plate 58 mounts two pins 60 located on either side of the imaginary parting line 80. FIGS. 10 and 11 illustrate in a modified form wherein the pins 60 are located on the imaginary line 80 and that the knife 78, by being formed with slots 88, to provide clearance for the pins 60, cuts the web segments along the line 80 but with interrupted uncut portions corresponding to the slots 88. If one chose to produce bag stacks by using the construction shown in FIGS. 10 and 11 the portion of the web material that can be allocated to define the volume of the bag would be increased.

Although the best mode contemplated for carrying out the present invention has been herein shown and described, it will be apparent that modification and variation may be made without departing from what is regarded to be the subject matter of the invention.

What is claimed is:

1. In an apparatus for manufacturing thermoplastic bags from a roll of flattened tubular thermoplastic web material having a narrow longitudinally extending median strip removed from one flattened side thereof, means for sealing and severing the web transversely with respect to the median strip thereby forming a segment of a generally rectangular configuration, and a rotary transfer means for transferring and stacking individual formed segments in succession on at least one pair of upright pins mounted to a stacking plate, the lateral sides of the segment draping over the stacking plate, wherein the improvement comprises the punching of mounting holes in the segment by the force of the rotary transfer means depositing the segment on the pins through an opposite flattened side of the segment facing and in the vicinity of the median strip, each pin having a sharpened conical shaped head projecting upwardly from a cylindrical shaft mounted to the stacking plate, each shaft having a diameter substantially less than the diameter at the base of the conical shaped head thereby facilitating the downward sliding of the pierced segment beyond the base of the conical shaped head without appreciable force applied by the rotary transfer means, and further including means for transporting the stacking plate and the draping segments stacked thereon after a selected number of segments are pinned on the conical headed pins to a means for producing two bags from each segment in the stack, the bag producing means comprising a cutting element positioned above the selected number of draping segments pinned to the conical headed pins on the stacking plate transported thereunder by the transporting means, power means for moving the cutting element downwardly for dividing the stack of segments through the opposite flattened side along a longitudinal centerline extending along the median strip and producing two stacks of bags mounted on the conical headed pins, and wherein the one pair of conical headed stacking pins mounted on the stacking plate are longitudinally spaced apart and positioned for piercing the segment through the opposite flattened side on the centerline extending through the median strip of the segment, and wherein the cutting element comprises a sectioned knife means for clearing the conical headed stacking pins aligned on the centerline of the median strip when dividing the layer of stacked web segments thereby providing uncut spaces around the pins for holding the two stacks of bags on the conical headed pins.

2. The apparatus according to claim 1, wherein the sectioned knife means is provided with interrupted cutting edges for producing a series of incisions and uncut bond portions, and the stacking plate is provided with a resilient pad vertically aligned below the interrupted cutting edges for protecting the cutting edges following the perforation of the stack of segments.

3. In an apparatus for manufacturing thermoplastic bags, a method for transferring non-apertured generally rectangular web segments produced from a flattened roll of tubular thermoplastic material to a stacking station for accumulating the transferred segments in a stack, each segment having an open medial zone in one flattened side thereof, comprising the steps of grasping each segment on lateral sides of the open medial zone by a pair of rotary arms having grasping means connected to a controlled source of vacuum, rotating the rotary arms and transferred the grasped segment in an arcuate path to the stacking station comprising an accumulating device having at least one pair of sharpened conical headed stacking pins, the pins having cylindrical shanks of a diameter substantially less than the diameter of the base of the conical headed portion, puncturing a second flattened side of the segment extending opposite the open medial zone in the one flattened side with the conical headed pins in the course of stacking the segment on said accumulated device, maintaining the grasp of the grasping means at least until the rotary arms have moved beyond the base of the conical headed portion, accumulating a selected number of successive segments on the cylindrical shank below the base of conical head portion in a stack, transferring the accumulating device and the stack of segments to a cutting station having a cutting element, and cutting the stack of segments with the cutting element through the second flattened side along a centerline extending along the open medial zone; and wherein the one pair of conical headed pins is positioned on the centerline extending along the open medial zone which penetrate and puncture the segment through the second flattened side on the centerline and wherein the cutting element is sectioned for clearing the pins for producing a line of cut and uncut bond portions extending along the centerline containing the pair of conical headed pins defining two stacks of bags mounted on opposite sides of the centerline on the pair of conical headed pins.

* * * * *